US005860764A

United States Patent [19]

Roberts

[11] Patent Number: 5,860,764

[45] Date of Patent: Jan. 19, 1999

[54] ASPHALT ROLLER ATTACHMENT FOR ROLLING RUMBLE STRIPS

[76] Inventor: Ronnie F. Roberts, 110 Pepper La., Paducah, Ky. 42001

[21] Appl. No.: 982,290

[22] Filed: Dec. 2, 1997

[51] Int. Cl.[6] ..... E01C 23/02

[52] U.S. Cl. ..... 404/93; 404/124; 404/128

[58] Field of Search ..... 404/93, 122, 124, 404/128, 94

[56] References Cited

U.S. PATENT DOCUMENTS

| | | | |
|---|---|---|---|
| 4,878,713 | 11/1989 | Zanetis . | |
| 5,114,269 | 5/1992 | Shepard | 404/122 |
| 5,304,013 | 4/1994 | Parsons | 404/128 |
| 5,391,017 | 2/1995 | Thomas et al. . | |
| 5,415,495 | 5/1995 | Johnson . | |
| 5,456,547 | 10/1995 | Thomas et al. | 404/94 |
| 5,484,228 | 1/1996 | Thomas et al. . | |
| 5,582,490 | 12/1996 | Murray . | |
| 5,607,255 | 3/1997 | Thomas et al. . | |

OTHER PUBLICATIONS

Asphalt Contractor, J. Schmidt, *Ready to Rumble*, Mar. 1997, pp. 42–48.

*Primary Examiner*—Thomas B. Will
*Assistant Examiner*—Raymond W. Addie
*Attorney, Agent, or Firm*—Richard C. Litman

[57] ABSTRACT

A rumble strip rolling device for attachment to a conventional asphalt roller. The rumble strip rolling device includes a support member for attachment to the asphalt roller, a pivot member having one end thereof pivotally secured to the support member for movement between a first position and a second position, a slide member slidably mounted on the pivot member for movement between a third position and a fourth position, a first hydraulic cylinder for adjusting the pivot member between the first position and the second position, a second hydraulic cylinder for adjusting the slide member between the third position and the fourth position, a roller drum assembly having a roller drum frame and a roller drum rotatably supported on a shaft that is supported by the roller drum frame, and a connector for pivotally connecting the roller drum frame to the slide member. The shaft has a first axis substantially perpendicular to a direction of movement of the asphalt roller and the roller drum frame is pivotal about a second axis substantially parallel to the direction of movement of the asphalt roller. Pivotal movement of the roller drum frame about the second axis allows the shaft and the roller drum thereon to remain substantially parallel to a surface being rolled during rolling operations. The first and second hydraulic cylinders enable the vertical and lateral position of the roller drum assembly to be selectively adjusted during use and non-use of the roller drum.

16 Claims, 5 Drawing Sheets

ASPHALT ROLLER ATTACHMENT FOR ROLLING RUMBLE STRIPS

BACKGROUND OF THE INVENTION

1. Field of the Invention

The present invention relates to a device attached to a conventional asphalt roller for the purpose of creating a series of depressions, typically known as rumble strips, in fresh asphalt.

2. Description of Related Art

In an effort to increase the safety of highway travel, many states utilize rumble strips to warn motorists of a hazardous situation. Typically, the rumble strips are placed on the shoulder of the road to warn motorists that they are about to veer off the road, or in the roadway itself to warn motorists of upcoming toll booths, construction, or intersections. As a vehicle drives over a series of rumble strips, the rumble strips produce noticeable vibrations in the steering column and an audible sound. Both the vibrations and the sound are useful to alert a driver who is unaware of an upcoming situation or who is drowsy and unaware of the vehicle's position on the roadway.

Rumble strips are typically formed as grooved patterns in the surface of the roadway. The two fundamental techniques used to create rumble strips are milling and rolling. The milling process involves passing a toothed milling drum over the road surface. As the milling drum rotates, the teeth thereon cut shallow radius grooves into the road surface. To properly space apart the grooves, a mechanical or hydraulic system sequentially raises and lowers the milling drum. In contrast, the rolling process involves passing over the road surface a rolling drum equipped with a plurality of radially spaced profile strips. As the rolling drum rotates, the profile strips displace still soft asphalt to form a groove corresponding in shape to the profile strips.

The related art contains several examples of devices useful for treating road surfaces. U.S. Pat. No. 4,878,713 issued to Zanetis on Nov. 7, 1989, discloses a pavement planar which is carried on the twin lift arms of a skid-steer front end loader. The pavement planar has a housing and a toothed drum which is rotatably mounted within the housing for planing operation of the road surface. A frame member is secured to the lift-arms of the front end loader, and the housing is mounted to the frame member for lateral adjustment upon a pair of guide arms and tilting adjustment about a trunnion having fore-aft axis. Depending upon whether the housing is clamped to the frame member, a single hydraulic cylinder provides for tilting adjustment of the housing about the trunnion or lateral adjustment of the housing along the guide arms.

U.S. Pat. Nos. 5,391,017 issued on Feb. 21, 1995, 5,484,228 issued on Jan. 16, 1996, and 5,607,255 issued on Mar. 4, 1997, each to Thomas et al., disclose an apparatus for cutting Sonic Noise Alert Pattern (SNAP) depressions or rumble strips in the surface of an asphalt road. The Thomas et al. '017 reference discloses the use of an eccentric member provided in direct contact with the road surface, whereby rotation of the eccentric causes raising and lowering of a cutting drum during the course of a single revolution. The Thomas et al. '288 and '255 references disclose cam member provided in direct contact with the road surface, whereby rotation of the cam member causes raising and lowering of a cutting drum as the cam surfaces of the cam member contact the road surface during the course of a single revolution.

U.S. Pat. No. 5,582,490 issued to Murray discloses a piston wheel for use on an existing cold milling machine.

The piston wheel is preferably a pentagonal wheel which causes raising and lowering of a cutting head on the cold milling machine, whereby as the machine moves forward over the surface to be cut, the cutting head will be raised and lowered to produce intermittent cuts or rumble strips in the pavement surface.

U.S. Pat. No. 5,456,547 issued to Thomas et al. on Oct. 10, 1995 discloses a machine and method for forming the aforementioned SNAP type depressions in an asphalt road. The machine includes a single milling head with spaced bit sets that contact the road surface to form the depressions. The milling head is lowered to perform the necessary cutting action, the machine is advanced to effect the size of the depression, the milling head is raised to terminate the depression, and finally the machine is advanced farther to begin a new cutting procedure until a predetermined number of depressions have been formed.

U.S. Pat. No. 5,415,495 issued to Johnson on May 16, 1995, discloses a cutting machine which includes a cutting head and a drive device for driving the cutting head, as well as an engaging device for moving the cutting head out of and into contact with the road surface. The engaging device includes a hydraulic cylinder which is under control of an electronic proportional valve operated by a computer controller. The computer controller is programmed to raise and lower the cutting head as a function of the distance travelled by the machine as it moves forward over the road surface. The computer controller receives electrical impulses from a conventional wheel mounted encoder.

In the article Ready to Rumble appearing in the March 1997 issue of *Asphalt Contractor,* the article indicates that rolled rumble strips may be formed by an attachment drum on the roller or by mounting bars on a drum roller. The article continues by suggesting that the attachment is not a full machine, but is instead controlled with an hydraulic arm. The article makes no suggestion for using more than one hydraulic arm.

None of the above inventions and patents, taken either singly or in combination, is seen to describe the instant invention as claimed.

SUMMARY OF THE INVENTION

In accordance with the below-identified objectives, the present invention is a rumble strip rolling device for attachment to a conventional asphalt roller. The device enhances the capabilities of the asphalt roller by allowing the asphalt roller to perform normal surface rolling operations as well as rumble strip rolling operations. The device generally comprises a support member which secures the device to the asphalt roller, a pivot member which is pivotally secured to the support member, a slide member slidably mounted upon the pivot member, a roller drum assembly connected to the slide member, and hydraulic cylinders that respectively control pivotal movement of the pivot member and linear travel of the slide member to selectively position the rolling drum assembly.

The support member is a rigid plate which is connected to the frame of the asphalt roller, preferably at one end of the asphalt roller. The pivot member is formed from a rigid beam having an I-shaped configuration, and one end of the pivot member is pivotally secured to the support member. The support member includes a pair of concentric, arcuate grooves positioned along a radial arc whose center is coincident with the pivot point of the one end of the pivot member. The arcuate grooves interact with the pivot member to limit travel distance of the pivot member between a first position where the pivot member is retracted fully upward and a second position where the pivot member is extended fully downward.

With the pivot member being substantially I-shaped, the pivot member is formed of a pair of elongate rails which are spaced apart by an intermediate, integral spanning member. The pivot member is positioned such that one rail thereof faces outwardly away from the support member and the other rail thereof faces the support member. The one rail includes an upper portion and an integral lower portion. The slide member is slidably mounted on the one rail by at least one bearing set, which includes a first bearing positioned above the upper portion of the one rail and a second bearing positioned below the lower portion of the one rail. The slide member is connected to the at least one bearing set such that one end of the slide member is proximal to the pivotal end of the pivot member, and an opposite end of the slide member is distal to the pivotal end of the pivot member. The slide member is disposed for movement along the one rail between a third position (fully retracted toward the pivotal end of pivot member) and a fourth position (fully extended away from the pivotal end of pivot member).

The roller drum assembly generally includes a roller drum frame and a roller drum supported on the frame. The roller drum is a cylindrical drum which has a plurality of radially spaced profile strips thereon and which is mounted on a shaft for rotation. The opposite ends of the shaft are supported by the roller drum frame, whereby the roller drum is free to rotate about the shaft. The shaft has a first axis which is substantially perpendicular to the direction of movement of the asphalt roller. The roller drum assembly is connected to the distal end of the slide member by a connector which supports a bearing element having a second axis substantially parallel to the direction of movement of the asphalt roller. The bearing element supports the roller drum frame for pivotal movement about the second axis. During use of the device, pivotal movement of the roller drum frame about the second axis of the bearing element maintains the shaft and the first axis thereof in substantially parallel relation to a surface being rolled.

The hydraulic cylinders are coupled to a hydraulic power unit which includes a hydraulic fluid source. The hydraulic power unit is connected to a power source, such as a 12 volt DC power supply available from the asphalt roller. Hydraulic controls are provided for operation of each hydraulic cylinder independently of the other. One hydraulic cylinder is vertically disposed, having a fixed end which is secured to the support member and an arm which is extendable and retractable under influence from the hydraulic power unit and controls. The arm has a terminal end connected to the pivot member for causing pivotal movement of the pivot member between the first and second positions. The other hydraulic cylinder is horizontally disposed, having a fixed end which is secured to the pivot member adjacent the pivotal end thereof and an arm which is extendable and retractable under influence from the hydraulic power unit and controls. The arm has a terminal end connected to the slide member for causing travel of the slide member between the third and fourth positions.

Accordingly, it is a principal object of the invention to provide an attachment to a conventional asphalt roller for the purpose of creating a series of rumble strips in fresh asphalt.

It is another object of the invention to provide an attachment to a conventional asphalt roller which allows a series of rumble strips to be formed behind or alongside of the roller drum of the conventional asphalt roller.

It is a further object of the invention to provide an attachment to a conventional asphalt roller which includes a vertically and horizontally retractable roller drum equipped with profile strips capable of forming rumble strips in fresh asphalt.

Yet another object of the invention is to provide an attachment to a conventional asphalt roller which includes a vertically and horizontally retractable roller drum equipped with profile strips capable of forming rumble strips in fresh asphalt, whereby the roller drum may be placed into one position while rolling rumble strips and retracted into another position while the attachment is not in use.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
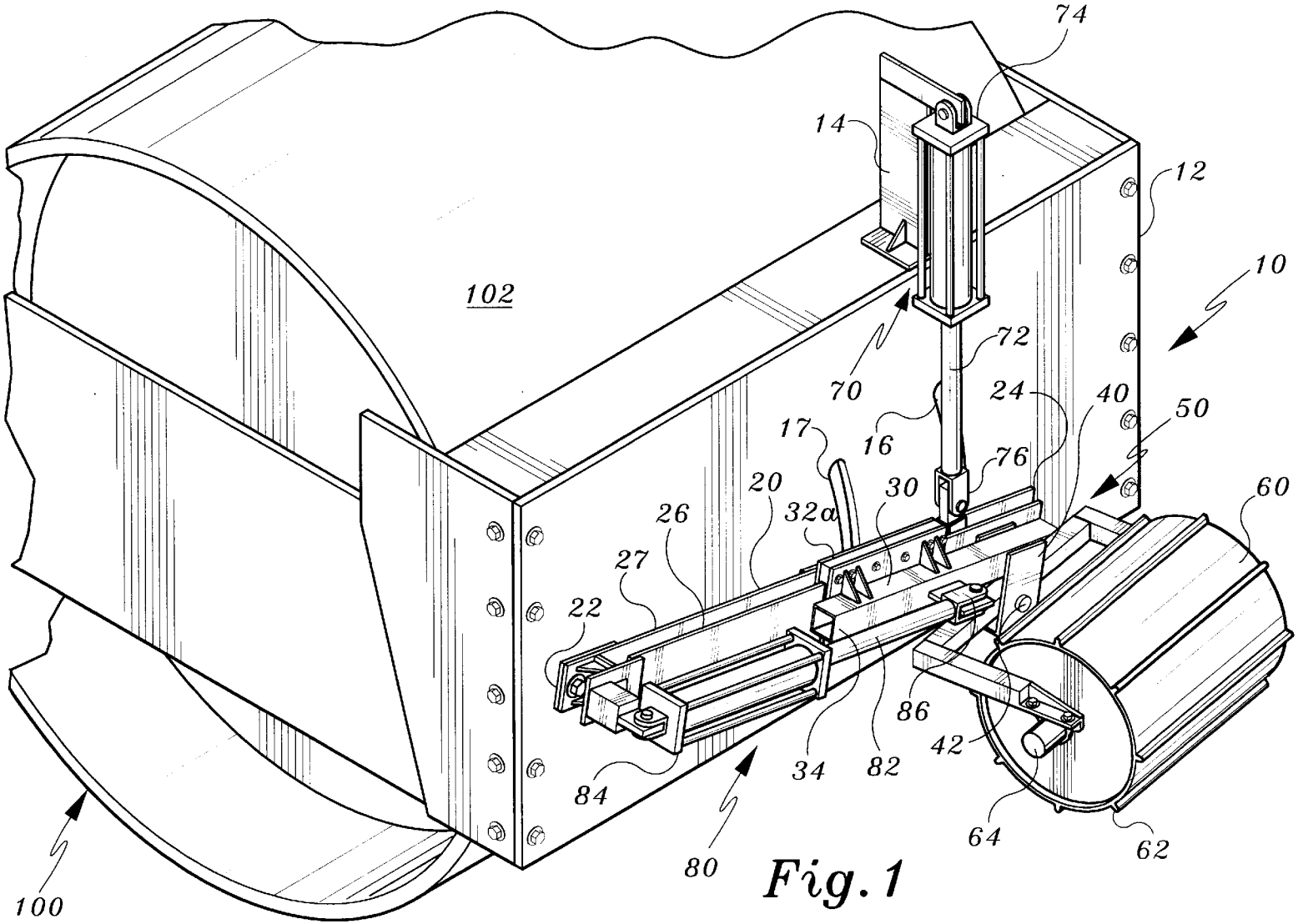
FIG. 1 is an environmental perspective view illustrating an attachment for rolling rumble strips as it is mounted to a conventional asphalt roller.

Referring now to the Figures by numerals of reference and first to FIG. 1, 10 denotes generally a rumble strip rolling device for attachment to a conventional asphalt roller 100 having a large rolling drum 102. The device 10 is intended to enhance the capabilities of the asphalt roller 100 by allowing the asphalt roller to perform normal surface rolling operations as well as rumble strip rolling operations. The device 10 is particularly useful in that the drum used to form rumble strips may be positioned either behind or to the side of the asphalt roller 100 during rolling operations, and subsequently retracted to an elevated position behind the asphalt roller during periods of non-use.

The device 10 generally comprises a support member 12 which secures the device to the asphalt roller 100, a pivot member 20 which is pivotally secured to the support member, a slide member 30 slidably mounted upon the pivot member 20, a rolling drum assembly connected to the slide member, and hydraulic cylinders 70, 80 that respectively control pivotal movement of the pivot member 20 and linear travel of the slide member 30, to selectively position the rolling drum assembly as described more fully hereinafter.

The support member 12 is a rigid plate, for example a steel plate, which is connected to the frame of the asphalt roller 100 using a plurality of conventional nut and bolt fasteners. As shown in FIG. 1, the support member 12 is positioned at one end of the asphalt roller 100. The support member 12 includes an upright extension 14 which is welded or otherwise secured thereto for supporting the hydraulic cylinder 70. The support member 12 also includes a pair of arcuate grooves 16, 17 formed through the plate, for the purpose of interacting with the pivot member 20 to limit travel distance of the pivot member between a first position (when the pivot member 20 is rotated and positioned fully upwardly) and a second position (when the pivot member 20 is rotated and positioned fully downwardly). Additional support for the major portions of the invention is provided by a support and stiffener plate assembly 27 (see FIG. 5), mounted behind plate 12, and interconnected to pivot member 20 by pins 28.

Figure 5:
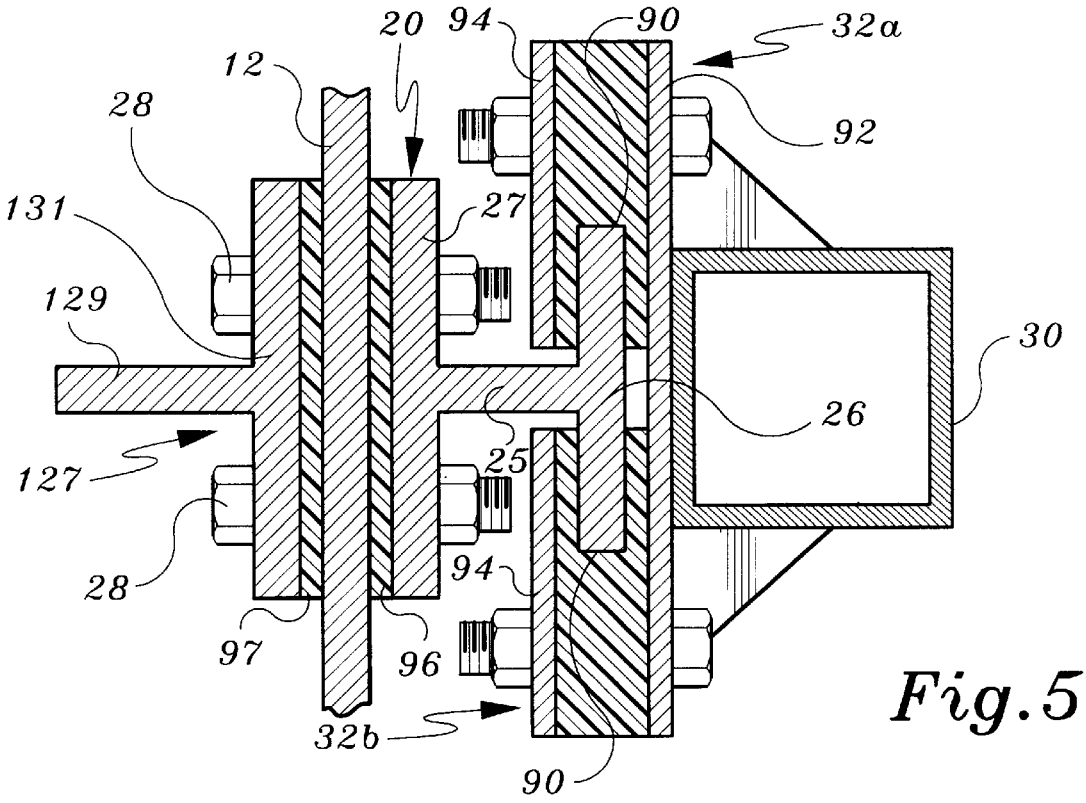
FIG. 5 is an enlarged scale cross sectional view illustrating the bearing sets used to slidably connect the slide member to the pivot member, and a support stiffener plate assembly providing additional support for the pivot member.

Referring now to FIGS. 1 and 5, the pivot member 20 is formed from a rigid beam, such as a steel beam, having an I-shaped configuration. The pivot member 20 is pivotally secured to the support member 12 at end 22 thereof by a single nut and bolt connector. A bearing (not shown) may be used to support pivotal movement of the pivot member, thereby minimizing friction during the course of its travel and reducing the likelihood of wear and fatigue of the nut and bolt connector. Such a bearing may be of conventional design. In addition, UHMW (ultra high molecular weight) inserts 96, 97 may be positioned intermediate the support member 12 and the pivot member 20, and the support member 20 and the stiffener assembly 127, to further reduce friction during movement of the pivot member. Stiffener assembly 127 may be of monolithic construction as shown in FIG. 5, or, preferably, simply be fabricated from two pieces of plate stock, spot welded together where the horizontal plate 129 meets the vertical plate 131. The arcuate grooves 16, 17 of the support member 12 are positioned along concentric radial arcs whose center is coincident with the pivot point of the end 22 of the pivot member 20. The other end 24 of the pivot member 20 has the pins 28, such as nut and bolt fasteners, positioned for travel within the arcuate grooves 16, 17. The arcuate grooves 16, 17 limit travel of the pivot member 20 through interaction with pins 28.

With the pivot member 20 being substantially I-shaped, the pivot member is formed of a pair of elongate rails which are spaced apart by an intermediate, integral spanning member 25. The pivot member 20 is positioned such that one rail 27 thereof faces the support member 12 and the other rail 26 thereof faces outwardly away from the support member. The rail 26 includes an upper portion and an integral lower portion. The slide member 30 is slidably mounted on the pivot member 20, and specifically on the rail 26, by a bearing set. Each bearing set includes a first bearing 32*a* positioned above the upper portion of the rail 26 and a second bearing 32*b* positioned below the lower portion of the rail 26. Each bearing 32*a*, 32*b* is formed of a substantially U-shaped bearing surface 90 which is secured between a first retaining element 92 and a second retaining element 94 by means of nut and bolt connectors. Use of nut and bolt connectors or any other removable connector allows the bearing surface 90 to be replaced when worn. The bearing surface 90 of bearings 32*a*, 32*b* surrounds substantially the entire upper portion and lower portion of the rail, respectively. It is preferable to utilize a low friction plastic material as the U-shaped bearing surface 90, which may be formed of a single integral structure or, alternatively, a plurality of laminar sheets stacked together to have an equivalent configuration.

The slide member 30, which is formed of a generally square-shaped steel tubing, is connected to the first retaining element 92 of the bearing set by welding or other like means. The slide member 30 has one end 34 thereof which is proximal to the end 22 of the pivot member 20, and an opposite end 36 thereof which is distal to the end 22 of the pivot member 20. The slide member 30 is disposed for movement along the rail 26 between a third position (fully retracted toward end 22 of pivot member 20) and a fourth position (fully extended away from end 22 of pivot member 20).

Figure 6:
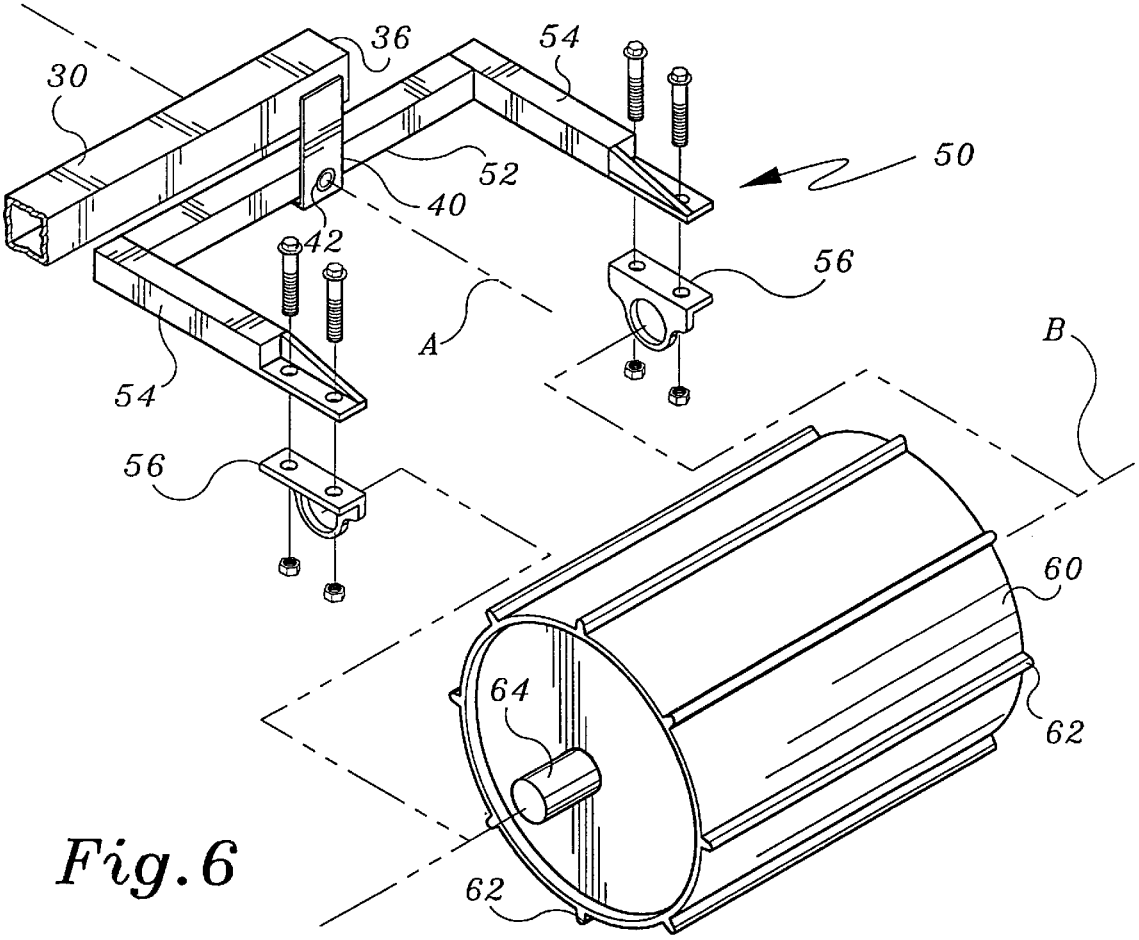
FIG. 6 is an exploded perspective view illustrating the connecting between the slide member, the roller drum frame, and the roller drum.

Referring now to FIG. 6, a roller drum assembly is connected to the distal end 36 of the slide member 30 by a connector 40. The roller drum assembly generally includes a roller drum frame 50 and a roller drum 60 supported on the frame 50. The connector 40 is welded or otherwise secured to the distal end 36 of the slide member 30 and the connector 40 supports a bearing element 42 having an axis A substantially parallel to the direction of movement of the asphalt roller. The bearing element 42 supports the roller drum frame 50 for pivotal movement about the axis A.

The roller drum frame 50 includes a cross-beam 52 which is mounted upon the bearing element 42, and a pair of lateral arms 54 which extend in the same direction from opposite ends of the cross-beam 52. The lateral arms 54 are preferably welded or otherwise integrally connected to the cross-beam 52 to provide a rigid roller drum frame 50. The frame 50 also includes a pair of shaft support members 56 which are removably connected to the terminal ends of each lateral support arm 54. Each support member 56 has an aperture which is sized and configured to receive an end of shaft 64, as discussed immediately hereinafter.

The roller drum 60 is a cylindrical drum which is mounted on the shaft 64 for rotation thereon. The opposite ends of the shaft 64 are supported by the shaft support members 54 of the frame 50, as described above. Once the shaft 64 is supported by the roller drum frame 50, the roller drum 64 is free to rotate about shaft 60. Shaft 64 has an axis B which is substantially perpendicular to the direction of movement of the asphalt roller. During use of the device 10, pivotal movement of the frame assembly 50 about the axis A of bearing element 42 maintains the shaft 64 and its axis B in substantially parallel relation to a surface being rolled. To form spaced rumble strips in the surface being rolled, the roller drum 60 is provided with a plurality of circumferentially spaced profile strips 62 which are secured to the drum in parallel relation to the axis B.

Figure 7:
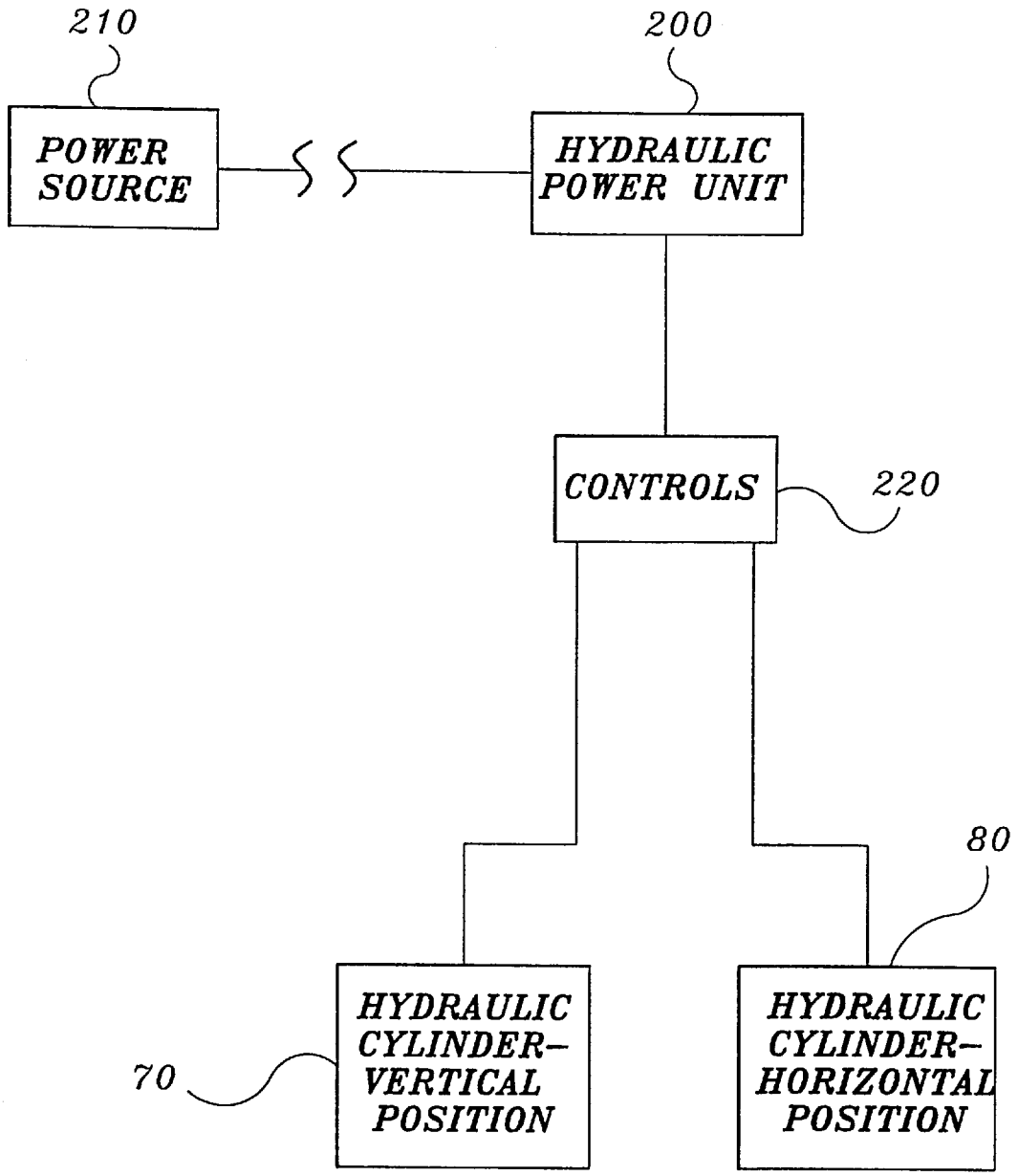
FIG. 7 is a schematic diagram illustrating the hydraulic power system which controls operation of the hydraulic cylinders.

Referring now to FIGS. 1 and 7, operation of the hydraulic cylinders 70, 80 will now be addressed. The hydraulic cylinders 70, 80 are coupled to a hydraulic power unit 200 (which includes a hydraulic fluid source). The hydraulic power unit 200 is connected to a power source, such as a 12 volt DC power supply available from the asphalt roller 100.

Hydraulic controls 220, of the type which are well known in the art, are provided for operation of each hydraulic cylinder 70, 80 independent of the other. The hydraulic cylinder 70 is vertically disposed, having a fixed end 74 which is secured to the support member 12 at the upright extension 14. Opposite from the fixed end is an arm 72 which is extendable and retractable under influence from the hydraulic power unit 200 and controls 220. The arm 72 has a terminal end provided with a connector 76 that attaches to the pivot member 20 adjacent end 24 thereof. The connector 76 is a standard pin-connector which allows the angular position of the pivot member 20 to vary with respect to the arm 72 as the arm moves between a fully extended and fully retracted position. Thus, the pivot member 20 remains free to travel about its pivot point, limited only by the interaction of pin 28 and arcuate groove 16 as discussed above. The hydraulic cylinder 80 is horizontally disposed, having a fixed end 84 which is secured to the pivot member 20 adjacent end 22 thereof. Opposite from the fixed end is an arm 82 which is extendable and retractable under influence from the hydraulic power unit 200 and controls 220. The arm 82 has a terminal end provided with a connector 86 that attaches to the slide member 30. The connector 86 is a standard pin-connector as described above, however, the position of the slide member 30 and the arm 82 remain in a fixed, substantially parallel arrangement. Thus, the slide member 20 is extendable and retractable to the extent allowed by the hydraulic cylinder 80.

Figure 2:
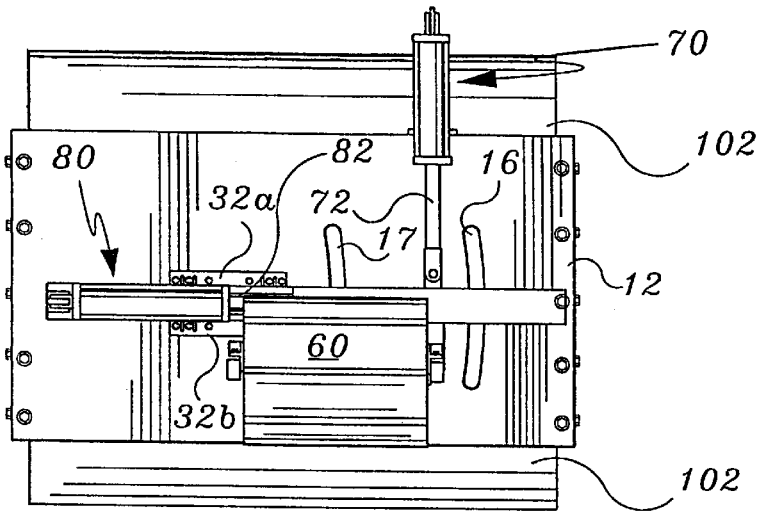
FIG. 2 is a rear end view of the attachment for rolling rumble strips with both hydraulic cylinders fully retracted to place a rumble strip rolling drum behind the asphalt roller in an elevated position.
Figure 3:
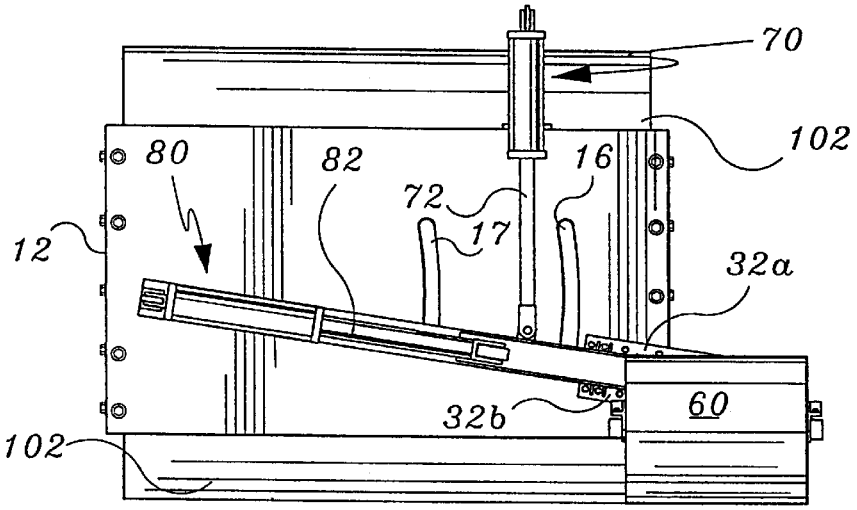
FIG. 3 is a rear end view of the attachment for rolling rumble strips with one hydraulic cylinder partially retracted and another fully extended to place the rumble strip rolling drum behind the asphalt roller and in contact with a surface to be rolled.
Figure 4:
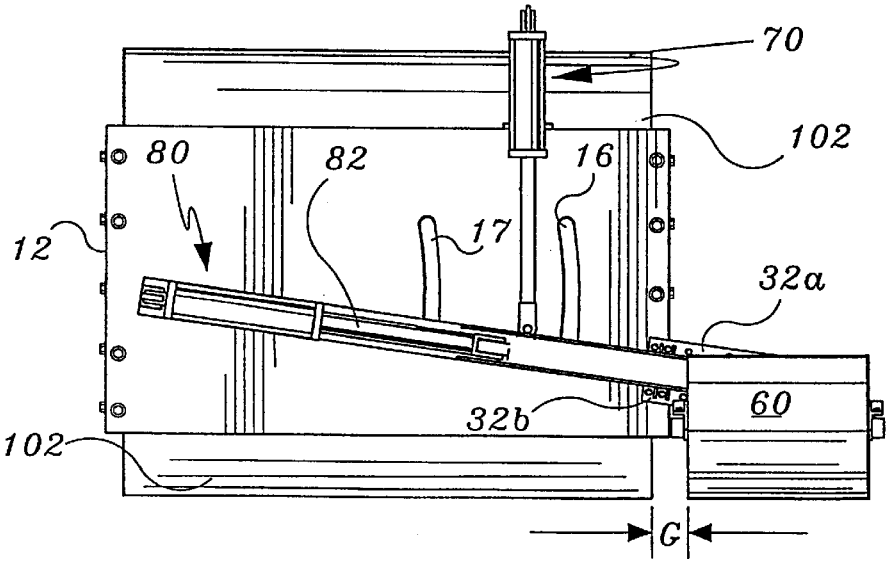
FIG. 4 is a rear end view of the attachment for rolling rumble strips with a horizontal hydraulic cylinder fully extended and a vertical cylinder somewhat less than fully extended, to place the rumble strip rolling drum beside and beyond the track of the asphalt roller and in contact with the surface to be rolled.

Referring now to FIGS. 2–4, operation of the device 10 will be described hereinafter. FIGS. 2–4 are largely diagrammatic views so as to more clearly show the operation of the invention. When the roller drum 60 is not in use, the arm 82 of hydraulic cylinder 80 is intended to be retracted and the arm 72 of hydraulic cylinder 70 is intended to be at least partially retracted, thereby elevating the roller drum from the surface upon which the asphalt roller 100 travels (shown at FIG. 2). To accomplish this, hydraulic cylinder 70 is used to effect movement of pivot arm 20 from the second position toward the first position and hydraulic cylinder 80 is used to effect movement of the slide arm 30 from the fourth position toward the third position. The retraction of arms 72, 82 is accomplished using the controls 220.

When it is desirable to lower the roller drum 60 for application of rumble strips in fresh asphalt, the roller drum 60 may be positioned either directly behind or, preferably, to the side of the asphalt roller 100. To position the roller drum 60 behind the asphalt roller 100, as shown in FIG. 3, the hydraulic cylinder 70 is used to extend the arm 72, thereby causing pivot member 20 to extend fully downward from the first position into the second position. The amount of compression force applied by the roller drum 60 against the fresh asphalt surface may be adjusted by regulating the height of the roller drum 60 with respect to the drum 102 of the asphalt roller 100. Of course, the compression force just mentioned is provided by the mass of the asphalt roller translated through the arm 72 to the roller drum 60. This is accomplished by using the controls 220 to effect arm 72 of hydraulic cylinder 70, thereby adjusting the location of the pivot member 20 between the first and second positions.

To position the roller drum 60 fully to the side of the asphalt roller 100, as shown in FIG. 4, the hydraulic cylinder 80 is used fully to extend the arm 82 and the hydraulic cylinder 70 is used to partially extend the arm 72. Extension of arm 82 causes slide member 30 to move away from the end 22 of pivot member 20 from the third position toward the fourth position, and extension of arm 72 causes pivot member 20 to extend downwardly from the first position toward the second position. The amount of compression force applied by the roller drum 60 against the fresh asphalt surface may be adjusted as before. It is important to note here that a gap G is provided between the tracks of the rollers 102 and 60, so that the force of the rolling operation does not cause an unintended water bead or welt to be uplifted and formed in hot asphalt in the area G, as would likely occur if no such gap were provided.

During use of the roller drum 60 to perform rumble strip rolling operations, the axis A of the bearing element 42 is maintained in substantially parallel relation to the direction of movement of the asphalt roller 100. This allows the roller drum frame 50 to pivot about the axis A to align the roller drum 60 with the slope of the surface being rolled. Furthermore, the axis B of shaft 64 is maintained in substantially perpendicular relation to axis A and substantially parallel to the surface being rolled.

While the present invention has been described with numerous parts thereof being connected together by nut and bolt connectors, it should be apparent to one skilled in the art that a permanent connection may be made, where suitable, by forming a welded joint or other like means. Likewise, it should also be apparent that a removable connection may be made, where suitable, using known equivalents to nut and bolt connectors. Also, it should be apparent to one skilled in the art that the configuration of the rail 26 may modified in such a way so as to obviate the need for a bearing set. Instead, it is contemplated by the inventor that use of a single bearing, rather than a set, is possible where the rail is configured to prevent vertical displacement of the slide member. Therefore, it should also be apparent that the configuration of the bearing surface of the bearing is primarily dependent upon the configuration of the rail over which the bearing rides.

It is to be understood that the present invention is not limited to the embodiments described above, but encompasses any and all embodiments within the scope of the following claims.

I claim:

1. A rumble strip rolling device for attachment to an asphalt roller, the rumble strip rolling device comprising:

a support member for attachment to an asphalt roller;

a pivot member having one end thereof secured to said support member, said pivot member being pivotal about said one end for movement between a first position and a second position;

a slide member slidably mounted on said pivot member for movement between a third position and a fourth position, said slide member having an end proximal to said one end of said pivot member and an end distal from said one end of said pivot member;

a roller drum assembly including:

a roller drum frame connected to said slide member, and a roller drum rotatably supported on a shaft, said shaft being supported on said roller drum frame and having a first axis substantially perpendicular to a direction of movement of the asphalt roller and substantially parallel to a surface being rolled, said roller drum having a plurality of circumferentially spaced profile strips thereon;

first adjusting means secured to said support member and pivot member for adjusting said pivot member between said first position and said second position; and second adjusting means secured to said slide member and pivot member for adjusting said slide member between said third position and said fourth position.

2. The rumble strip rolling device according to claim 1, wherein said support member includes a pair of concentric, arcuate grooves, said arcuate grooves being positioned radially from the pivot point of said one end of said pivot member, said arcuate grooves defining said first position and said second position; and said pivot member has pairs of pin means positioned for travel within said arcuate grooves.

3. The rumble strip rolling device according to claim 1, wherein said pivot member includes an elongate rail; and said slide member is slidably mounted on said pivot member by a bearing set, including a first bearing surface above said elongate rail and a second bearing surface below said elongate rail.

4. The rumble strip rolling device according to claim 3, wherein said elongate rail includes an upper portion and a lower portion;

said first bearing surface contacting said upper portion; and said second bearing surface contacting said lower portion.

5. The rumble strip rolling device according to claim 3, wherein said first and second bearing surfaces comprise a low friction plastic material having a substantially U-shaped configuration adapted to receive a portion of said elongate rail.

6. The rumble strip rolling device according to claim 1, wherein said first adjusting means comprise:

a hydraulic fluid source;

a first hydraulic cylinder coupled to said hydraulic fluid source, said first hydraulic cylinder having a cylinder portion and an arm reciprocable from said cylinder portion, said cylinder portion being secured to said support member and said arm being secured to said pivot member adjacent said other end thereof.

7. The rumble strip rolling device according to claim 1, wherein said second adjusting means comprise:

a hydraulic fluid source;

a second hydraulic cylinder coupled to said hydraulic fluid source, said second hydraulic cylinder having a cylinder portion and an arm reciprocable from said cylinder portion, said cylinder portion being secured to said pivot member adjacent said one end thereof and said arm being secured to said slide member adjacent said proximal end thereof.

8. The rumble strip rolling device according to claim 2, further comprising connecting means for pivotally connecting said roller drum frame to said distal end of said slide member for pivoting of said roller drum frame about a second axis substantially parallel to a direction of movement of the asphalt roller.

9. The rumble strip rolling device according to claim 8, wherein said connecting means comprise:

a connector secured to said distal end of said slide member; and a bearing element supported on said connector, said bearing element supporting said roller drum frame for pivoting about said second axis.

10. A rumble strip rolling device for attachment to an asphalt roller, the rumble strip rolling device comprising:

a support member for attachment to an asphalt roller;

a pivot member having one end thereof secured to said support member, said pivot member being pivotal about said one end for movement between a first position and a second position;

a slide member slidably mounted on said pivot member for movement between a third position and a fourth position, said slide member having an end proximal to said one end of said pivot member and an end distal from said one end of said pivot member;

first adjusting means secured to said support member and pivot member for adjusting said pivot member between said first position and said second position;

second adjusting means secured to said slide member and pivot member for adjusting said slide member between said third position and said fourth position;

a roller drum assembly including:

a roller drum frame, and a roller drum rotatably supported on a shaft, said shaft being supported on said roller drum frame and having a first axis substantially perpendicular to a direction of movement of the asphalt roller and substantially parallel to a surface being rolled, said roller drum having a plurality of circumferentially spaced profile strips thereon; and connecting means for pivotally connecting said roller drum frame to said distal end of said slide member for pivoting of said roller drum frame about a second axis substantially parallel to the direction of movement of the asphalt roller.

11. The rumble strip rolling device according to claim 10, wherein said support member includes a pair of concentric, arcuate grooves, said arcuate grooves being positioned radially from the pivot point of said one end of said pivot member, said arcuate grooves defining said first position and said second position; and said pivot member has pairs of pin means positioned for travel within said arcuate grooves.

12. The rumble strip rolling device according to claim 10, wherein said pivot member includes an elongate rail; and said slide member is slidably mounted on said pivot member by at least one bearing set, each of said at least one bearing set including a first bearing surface above said elongate rail and a second bearing surface below said elongate rail.

13. The rumble strip rolling device according to claim 12, wherein said elongate rail includes an upper portion and a lower portion;

said first bearing surface contacting said upper portion; and said second bearing surface contacting said lower portion.

14. The rumble strip rolling device according to claim 12, wherein said first and second bearing surfaces comprise a low friction plastic material having a substantially U-shaped configuration adapted to receive a portion of said elongate rail.

15. The rumble strip rolling device according to claim 10, wherein said first adjusting means comprise:

a hydraulic fluid source;

a first hydraulic cylinder coupled to said hydraulic fluid source, said first hydraulic cylinder having a cylinder portion and an arm reciprocable from said cylinder portion, said cylinder portion being secured to said support member and said arm being secured to said pivot member adjacent said other end thereof.

16. The rumble strip rolling device according to claim 10, wherein said second adjusting means comprise:

a hydraulic fluid source;

a second hydraulic cylinder coupled to said hydraulic fluid source, said second hydraulic cylinder having a cylinder portion and an arm reciprocable from said cylinder portion, said cylinder portion being secured to said pivot member adjacent said one end thereof and said arm being secured to said slide member adjacent said proximal end thereof.

* * * * *